United States Patent [19]

Ogawa

[11] Patent Number: 4,521,169

[45] Date of Patent: Jun. 4, 1985

[54] VANE PUMP WITH INTERMEDIATE ROTARY CASING AND DRIVE CLUTCH

[75] Inventor: Hitoshi Ogawa, Himeji, Japan

[73] Assignee: Mitsubishi Denki Kabushiki Kaisha, Tokyo, Japan

[21] Appl. No.: 594,133

[22] Filed: Mar. 28, 1984

[30] Foreign Application Priority Data

Mar. 31, 1983 [JP] Japan ..... 58-49053[U]

[51] Int. Cl.[3] ..... F04C 18/348

[52] U.S. Cl. ..... 418/69; 417/164; 417/173

[58] Field of Search ..... 417/164, 172, 173, 174, 417/69

[56] References Cited

U.S. PATENT DOCUMENTS 2,241,824 5/1941 Meyerhoefer ..... 418/90

FOREIGN PATENT DOCUMENTS 2557695 6/1977 Fed. Rep. of Germany ..... 418/173

*Primary Examiner*—Leonard E. Smith

*Attorney, Agent, or Firm*—Sughrue, Mion, Zinn, Macpeak and Seas

[57] ABSTRACT

A vane type pump having vanes 9 slidingly confined in radial slots 8*a* in a rotor 8 operating eccentrically in a cylindrical casing 6 rotatably disposed in the housing 4 of the pump. A clutch 10 engages and disengages the rotor with the pump shaft 2 according to the speed of the shaft. The provision of the frictionally rotatable casing and the clutch enables the pump to operate at high speed with minimal vane wear and with reduced or no lubricating oil.

6 Claims, 3 Drawing Figures

VANE PUMP WITH INTERMEDIATE ROTARY CASING AND DRIVE CLUTCH

BACKGROUND OF THE INVENTION

This invention relates to an improved vane type pump used for vacuum pumping, air pumping and the like.

In a conventional vane type pump, a cylindrical housing having inlet and outlet ports is secured to a structure such as the frame of an automotive generator. The housing has a cylindrical inner surface, one end being open and the other end being closed. A rotor is eccentrically disposed within the housing, and is mounted on the generator shaft. The rotor has a plurality of radial slots in its peripheral surface, in which a plurality of vanes are slidably disposed.

When the rotor is driven by the shaft the vanes are forced outwardly by centrifugal force into free sliding engagement with the inner surface of the housing, and as the vanes rotate in the housing air is sucked from the inlet port and discharged through the outlet port under a pumping action. The inlet port may be connected to a vacuum tank, for example, and the sucking of the air through such port will evacuate the air from the tank. To maintain good sliding conditions between the outer edges of the vanes and the inner surface of the housing lubricating oil is supplied to the contact surface between them.

When such a pump is operated at high speed or without sufficient lubricating oil, the outer edges of the vanes soon become worn due to their friction with the inner surface of the housing. If the vanes are made of carbon the outer edges tend to break off due to the decreased bonding between the carbon particles caused by the friction induced heating.

SUMMARY OF THE INVENTION

It is an object of the present invention to provide a vane type pump which can be operated at high speed and whose capacity is increased as compared with a conventional pump of this type. It is another object of the invention to provide a vane type pump which can be operated with reduced or intermittently no lubricating oil without adverse effect.

It is a further object of the present invention to provide a vane type pump in which the wear of the vane outer edges is minimized and in which they are not prone to breakage even when made of carbon.

These objects are accomplished by the provision of an intermediate cylindrical casing rotatably disposed between the housing and the rotor, and having an inner surface with which the vanes are slidingly engaged. The inlet and outlet ports communicate with the space formed between the rotor and the casing. The frictional drag of the vane ends against the inner surface of the casing causes the casing to rotate, albeit at a slower speed than the rotor, and this reduces the sliding wear of the vane edges.

DETAILED DESCRIPTION OF THE PREFERRED EMBODIMENTS

Figure 1:
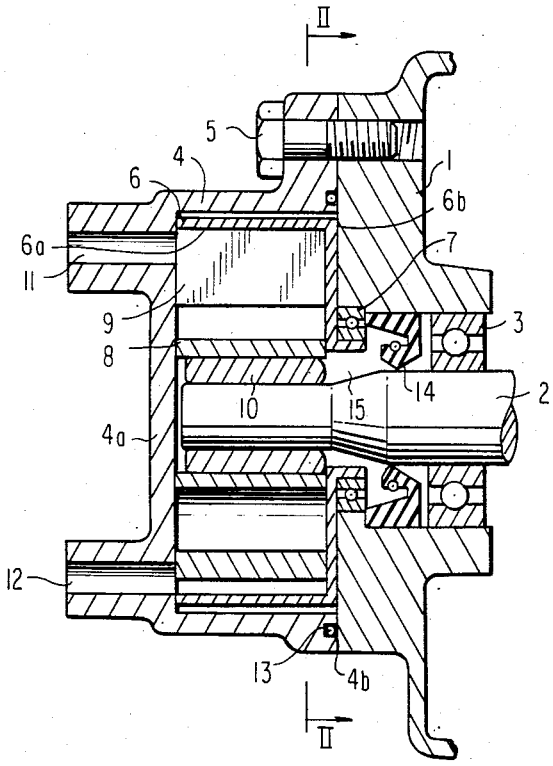
FIG. 1 is a longitudinal sectional view of one embodiment of a vane type pump in accordance with the present invention.
Figure 2:
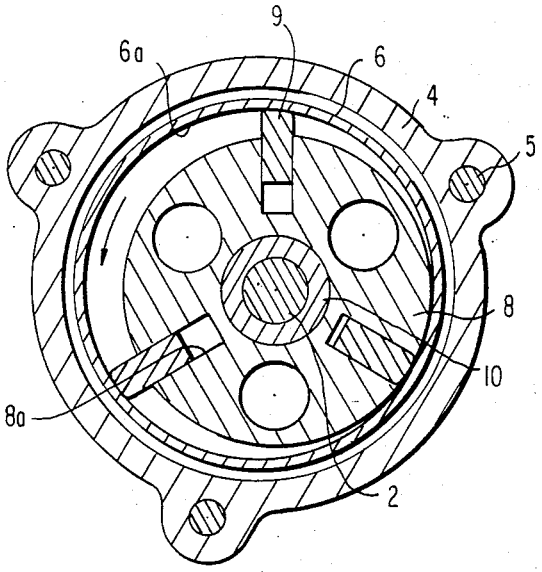
FIG. 2 is a transverse sectional view taken along line II—II of FIG. 1.

In FIGS. 1 and 2, a shaft 2 carrying a concentric rotor 8 is rotatably supported by bearing 3 in a frame 1 of an automotive generator, with one end of the shaft protruding from the frame. A housing 4 is attached to the frame by a plurality of bolts 5, one end confronting the frame 1 being open and the other end being closed by an end wall 4*a*. A cylindrical intermediate casing 6 is concentrically disposed in the housing, and is rotatably supported on the frame 1 by a bearing 7.

One end of the cylindrical casing 6 is open and confronts the housing 4; the other end is closed by a centrally apertured end wall 6*b* through which the shaft 2 extends. The rotor 8 is disposed eccentrically in the casing 6, and on the periphery thereof a plurality of equally spaced radial slots 8*a* are formed in which a plurality of vanes 9 are slidably placed. Between the shaft 2 and the rotor 8 a one-way clutch 10 secured to the shaft is disposed.

The clutch 10 connects the shaft to the rotor when the rotational speed of the shaft exceeds a predetermined value, and releases the rotor from the shaft when the speed drops below such value. The end wall 4*a* of the housing 4 is provided with an inlet port 11 and an outlet port 12 whose inner ends open to the space formed between the inner surface of the casing 6 and the outer surface of the rotor 8 at diametrically opposite sides of the rotor. The outer end of the inlet port 11 is connected to a vacuum tank, for example, not shown.

To hermetically seal the frame 1 to the housing 4 a packing 13 is mounted in a groove 4*b* formed in the housing. The sealing of an operating or bearing chamber 15 is implemented by a seal 14 secured to the frame 1 and bearing against the peripheral surface of the shaft.

In operation, when the generator is running the shaft 2 is driven to rotate in the direction indicated by the arrow. As the speed of the shaft increases and exceeds the predetermined value, the one-way clutch 10 engages the shaft with the rotor which then rotates in the same direction as the shaft.

With the rotor spinning the vanes 9 slide outwardly from the slots 8*a* due to centrifugal force, and their outer edges slidingly engage the inner surface of the casing 6. The casing 6 is then rotated in the same direction but at a somewhat lower speed than the rotor due to the frictional drag between the outer edges of the vanes and the inner surface of the casing. The relative speed between the vane edges and the casing surface is thus lower than the speed of the vane edges with respect to the inner surface of the housing in the conventional pump, and accordingly the wear of the vanes at their outer edges is attendantly reduced.

When the speed of the shaft 2 decreases the clutch 10 releases the rotor 8 from the shaft, whereafter the rotor will "free wheel" and gradually decelerate together with the casing 6 due to their inertia. Therefore, even if the shaft decreases its speed quickly or stops abruptly, no great change occurs in the relative speed between the vane edges and the casing surface, whereby the stresses imposed on the vanes are minimized. This condition helps to prevent the vanes from being damaged even when they are made of carbon.

Figure 3:
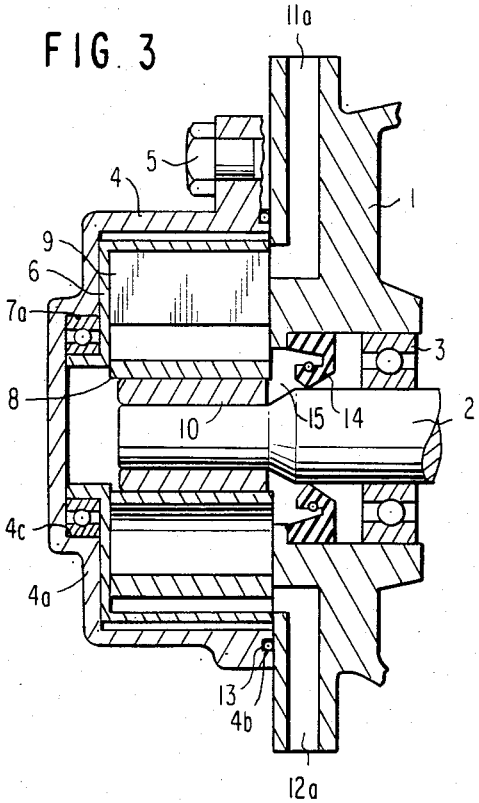
FIG. 3 is a longitudinal sectional view of another embodiment of a vane type pump in accordance with the present invention.

FIG. 3 shows another embodiment of the invention which is substantially the same in operation as the embodiment shown in FIGS. 1 and 2. The only difference between the two is that in the FIG. 3 embodiment the casing 6 is mounted in a recess 4*c* formed in the end wall 4*a* of the housing 4 by a bearing 7*a*, and the inlet and outlet ports 11*a*, 12*a* are formed in the frame 1.

Although both embodiments have been described in connection with a vacuum pump to be used in conjunction with an automotive generator, the pump according to the present invention can be equally used as a compressor, an air pump or the like driven through pulleys by an electric motor or other power source. It can also be utilized as a liquid pump.

What is claimed is:

1. A vane type pump, comprising:

(a) a frame member (1), (b) a housing (4) having a cylindrical inner surface and secured to said frame member, (c) a rotor (8) eccentrically disposed in said housing with respect to a center thereof, (d) a drive shaft (2) rotatably supported by the frame member and disposed concentrically within said rotor, (e) means for operatively coupling said shaft to said rotor, said coupling means comprising a one-way clutch (10) disposed between said shaft and said rotor for connecting the rotor to the shaft when the rotational speed of said shaft is higher than a predetermined value, and for releasing the rotor from the shaft when the rotational speed of said shaft is lower than the predetermined value, (f) a plurality of radial slots (8*a*) formed in a peripheral surface of said rotor, (g) a plurality of vanes (9) slidably disposed in said slots, said vanes being centrifugally extended from said slots by the rotation of said rotor, (h) an intermediate casing (6) rotatably disposed between said housing and said rotor and having a cylindrical inner surface (6*a*) with which outer ends of said vanes are slidably engaged upon centrifugal extension, and (i) an inlet port (11) and an outlet port (12) of said pump communicating with a space between said rotor and said casing, whereby the frictional drag of the vane ends along the inner surface of the casing rotates the casing to thereby reduce the degree of sliding between the vane ends and the casing and attendantly the wear of the vane ends.

2. A pump as claimed in claim 1, wherein said housing is open at one end and closed at the other end, and said open end is secured to said frame member.

3. A pump as claimed in claim 2, wherein said inlet and outlet ports are formed in said housing, and said casing is rotatably supported on the frame member.

4. A pump as claimed in claim 2, wherein said inlet and outlet ports are formed in said frame member, and said casing is rotatably supported in the housing (FIG. 3).

5. A pump as claimed in claim 3, wherein said casing is open at one end and closed at the other end, and said open end confronts said housing and said closed end confronts said frame.

6. A pump as claimed in claim 4, wherein said casing is open at one end and closed at the other end, and said open end confronts said frame and said closed end confronts said housing.

* * * * *